US009385497B2

(12) United States Patent
Paynter et al.

(10) Patent No.: US 9,385,497 B2
(45) Date of Patent: Jul. 5, 2016

(54) METHOD FOR ATTACHING A CONNECTOR TO A COAXIAL CABLE

(71) Applicant: CommScope Technologies LLC, Hickory, NC (US)

(72) Inventors: Jeffrey Paynter, Momence, IL (US); James Fleming, Orland Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/577,051

(22) Filed: Dec. 19, 2014

(65) Prior Publication Data

US 2015/0101189 A1 Apr. 16, 2015

Related U.S. Application Data

(63) Continuation of application No. 13/749,037, filed on Jan. 24, 2013, now Pat. No. 8,984,745.

(51) Int. Cl.

| | |
|---|---|
| ***H01R 43/02*** | (2006.01) |
| ***H01R 4/02*** | (2006.01) |
| ***H01R 9/05*** | (2006.01) |
| *H01R 101/00* | (2006.01) |

(52) U.S. Cl.

CPC ..... *H01R 43/02* (2013.01); *H01R 4/024* (2013.01); *H01R 9/05* (2013.01); *H01R 2101/00* (2013.01); *Y10T 29/49123* (2015.01); *Y10T 29/49174* (2015.01); *Y10T 29/49176* (2015.01); *Y10T 29/49179* (2015.01)

(58) Field of Classification Search

CPC ..... H01R 4/023; H01R 4/024; H01R 4/027; H01R 4/72; H01R 9/05; H01R 43/02; H01R 2101/00; Y10T 29/49174; Y10T 29/49173; Y10T 29/49179

See application file for complete search history.

(56) References Cited

U.S. PATENT DOCUMENTS

| | | | |
|---|---|---|---|
| 3,199,061 | A | 8/1965 | Johnson et al. |
| 3,291,895 | A | 12/1966 | Van Dyke |
| 3,394,400 | A | 7/1968 | Lamons |
| 3,461,409 | A | 8/1969 | Miller |
| 3,761,844 | A | 9/1973 | Reeder |
| 4,046,451 | A | 9/1977 | Juds et al. |
| 4,109,222 | A | 8/1978 | Frano et al. |
| 4,161,816 | A | 7/1979 | Frano et al. |
| 4,685,608 | A | 8/1987 | Kujas |
| 4,800,351 | A | 1/1989 | Rampalli et al. |
| 4,858,310 | A | 8/1989 | Sanders |

(Continued)

OTHER PUBLICATIONS

Sung Chul Kang, International Search Report for application PCT/US2013/069414, Feb. 26, 2014, Daejeon Metropolitan, Republic of Korea.

*Primary Examiner* — Carl Arbes

(74) *Attorney, Agent, or Firm* — Myers Bigel & Sibley, P.A.

(57) ABSTRACT

In a method for attaching a connector to a coaxial cable a solder perform is placed upon an end of an outer conductor of the cable. A connector body of the connector is seated upon an interface pedestal and the end of the outer conductor is inserted into a bore of the connector body against the interface pedestal. The outer conductor, the connector body and the interface pedestal contribute sidewalls to form a solder cavity, and the solder perform is heated. A seat may be applied to the interface pedestal to provide a thermal barrier and/or enhanced seal characteristics that are cost efficiently replaceable upon degradation.

17 Claims, 7 Drawing Sheets

(56) References Cited

U.S. PATENT DOCUMENTS

| | | | | |
|---|---|---|---|---|
| 4,910,998 | A | | 3/1990 | Wills et al. |
| 4,987,283 | A | | 1/1991 | Beinhaur et al. |
| 5,021,010 | A | | 6/1991 | Wright |
| 5,063,659 | A | | 11/1991 | Wright |
| 5,093,545 | A | | 3/1992 | McGaffigan |
| 5,093,987 | A | | 3/1992 | Scholz |
| 5,110,308 | A | | 5/1992 | Nishikawa et al. |
| 5,137,470 | A | | 8/1992 | Doles |
| 5,154,636 | A | | 10/1992 | Vaccaro |
| 5,167,533 | A | | 12/1992 | Rauwolf |
| 5,207,596 | A | | 5/1993 | Tran |
| 5,232,377 | A | | 8/1993 | Leibfried, Jr. |
| 5,234,865 | A | | 8/1993 | Goebel et al. |
| 5,281,167 | A | | 1/1994 | Le et al. |
| 5,290,984 | A | | 3/1994 | Gerhard, Jr. |
| 5,334,051 | A | | 8/1994 | Devine et al. |
| 5,354,217 | A | | 10/1994 | Gabel et al. |
| 5,422,614 | A | | 6/1995 | Rampalli et al. |
| 5,435,745 | A | | 7/1995 | Booth |
| 5,480,325 | A | | 1/1996 | Tran et al. |
| 5,558,538 | A | | 9/1996 | Delalle |
| 5,561,900 | A | | 10/1996 | Hosler, Sr. |
| 5,579,575 | A | | 12/1996 | Lamome et al. |
| 5,603,635 | A | * | 2/1997 | Delamotte ..... H01R 4/723 439/581 |
| 5,675,891 | A | | 10/1997 | Childs et al. |
| 5,802,710 | A | | 9/1998 | Bufanda et al. |
| 6,053,769 | A | | 4/2000 | Kubota et al. |
| 6,188,052 | B1 | | 2/2001 | Trucco |
| 6,229,124 | B1 | | 5/2001 | Trucco |
| 6,300,783 | B1 | | 10/2001 | Okubo et al. |
| 6,439,924 | B1 | | 8/2002 | Kooiman |
| 6,608,291 | B1 | | 8/2003 | Collins et al. |
| 6,667,440 | B2 | | 12/2003 | Nelson et al. |
| 7,122,770 | B2 | | 10/2006 | Thomas et al. |
| 7,127,806 | B2 | | 10/2006 | Nelson et al. |
| 7,900,344 | B2 | | 3/2011 | Ng et al. |
| 8,234,783 | B2 | | 8/2012 | Ng et al. |
| 2001/0001464 | A1 | | 5/2001 | Godwin |
| 2003/0040439 | A1 | | 2/2003 | Castiglioni et al. |
| 2004/0003936 | A1 | | 1/2004 | Schmitt et al. |
| 2004/0016741 | A1 | | 1/2004 | Evanyk |
| 2004/0089463 | A1 | | 5/2004 | Nguyen et al. |
| 2009/0232594 | A1 | | 9/2009 | Ng et al. |
| 2011/0113626 | A1 | | 5/2011 | Ng et al. |

* cited by examiner

METHOD FOR ATTACHING A CONNECTOR TO A COAXIAL CABLE

RELATED APPLICATION

This application is a continuation of and claims the benefit of prior U.S. application Ser. No. 13/749,037, filed Jan. 24, 2013, the disclosure of which is hereby incorporated herein in its entirety.

BACKGROUND OF THE INVENTION

1. Field of the Invention

The invention relates to a connector and cable interconnection. More specifically, the invention relates to a connector and cable interconnection method and apparatus with improved manufacturing efficiency and electrical performance characteristics.

2. Description of Related Art

Commonly owned U.S. Pat. No. 5,802,710, titled "Method of Attaching a Connector to a Coaxial Cable and the Resulting Assembly" by Bufanda et al, issued Sep. 8, 1998, hereby incorporated by reference in its entirety, discloses an electrical connector for use with coaxial cable and a method for attaching same. As shown for example in FIGS. 1 and 2, the connector may be attached to the coaxial cable with a high level of quality control via an assembly apparatus, as disclosed in commonly owned U.S. Pat. No. 7,900,344, titled "Cable and Connector Assembly Apparatus and Method of Use" by Ng et al, issued Mar. 8, 2011, hereby incorporated by reference in its entirety.

The U.S. Pat. No. 5,802,710 connector utilizes an insulating disc retained upon the inner connector and against the cable dielectric and outer conductor. Induction heating of a solder preform wrapped around the outer conductor creates a molten solder pool in a cylindrical solder cavity formed between the outer conductor, the insulating disc and the connector body. The insulating disc prevents the molten solder from migrating out of the cavity, fouling the connector bore and/or shorting the outer and inner conductors.

Competition within the cable and connector assembly industry has increased the importance of improving the electro-mechanical characteristics of the cable and connector interconnection while minimizing requirements for proper assembly.

Therefore, it is an object of the invention to provide a connector and cable interconnection method and apparatus that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The inventors have recognized that the insulating disc relied upon in the prior connector and assembly apparatus to provide the molten solder containment during interconnection complicates manufacture and introduces an impedance discontinuity that may degrade the electrical performance of the resulting interconnection.

Figure 3:
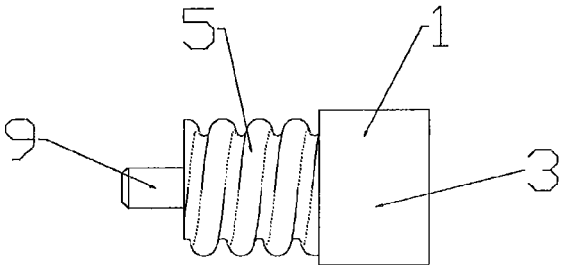
FIG. 3 shows a schematic side view of a prepared end of a coaxial cable.

The end of a coaxial cable 1 may be prepared for interconnection by stripping back the protective jacket 3 (if present), outer conductor 5, dielectric 7 and inner conductor 9 to expose desired lengths of each at the cable end, for example as shown in FIG. 3.

Figure 4:
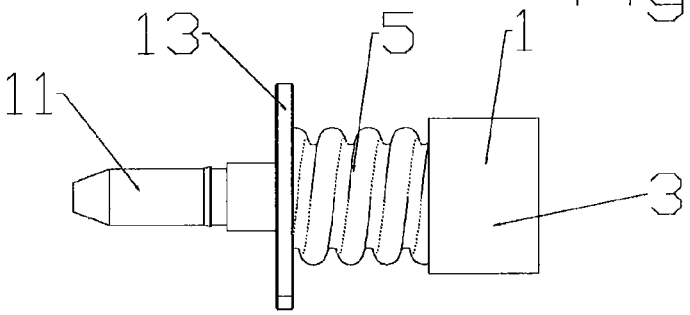
FIG. 4 shows a schematic side view of the coaxial cable of FIG. 3, with solder shield and inner contact.
Figure 5:
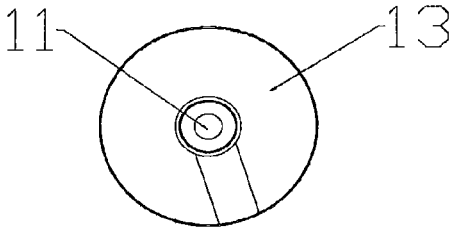
FIG. 5 shows a schematic end view of the cable of FIG. 4.

Depending upon the desired interconnection interface and/or coaxial cable 1 configuration, an inner contact 11 may be required to adapt the inner conductor 9 to the desired connection interface inner conductor dimensions. If needed, an inner contact 11 may be soldered upon the prepared end of the inner conductor 9. To protect the dielectric 7 from thermal damage during soldering, a removable solder shield 13 may be applied between the inner contact 11 and the outer conductor 5 and dielectric 7, for example as shown in FIGS. 4 and 5.

Figure 6:
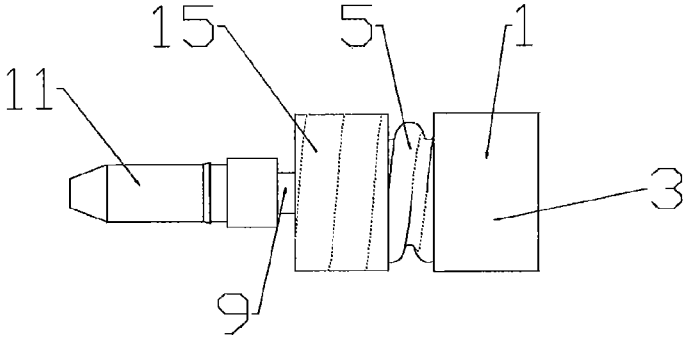
FIG. 6 shows a schematic side view of the coaxial cable of FIG. 3, solder preform and inner contact attached, ready for insertion into a connector body bore for solder interconnection.

A solder preform 15 may be applied proximate the end of the outer conductor 5, for example, wrapped around the outer conductor 5 as shown in FIG. 6.

Figure 7:
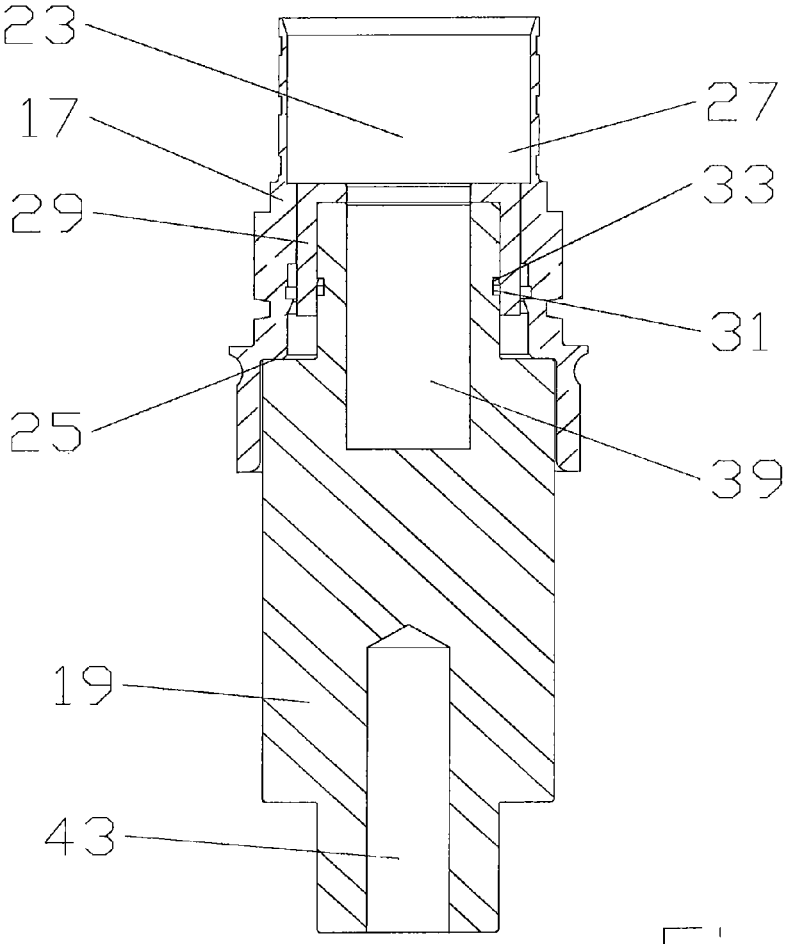
FIG. 7 shows a schematic cut-away side view of a connector body seated upon an interface pedestal.
Figure 8:
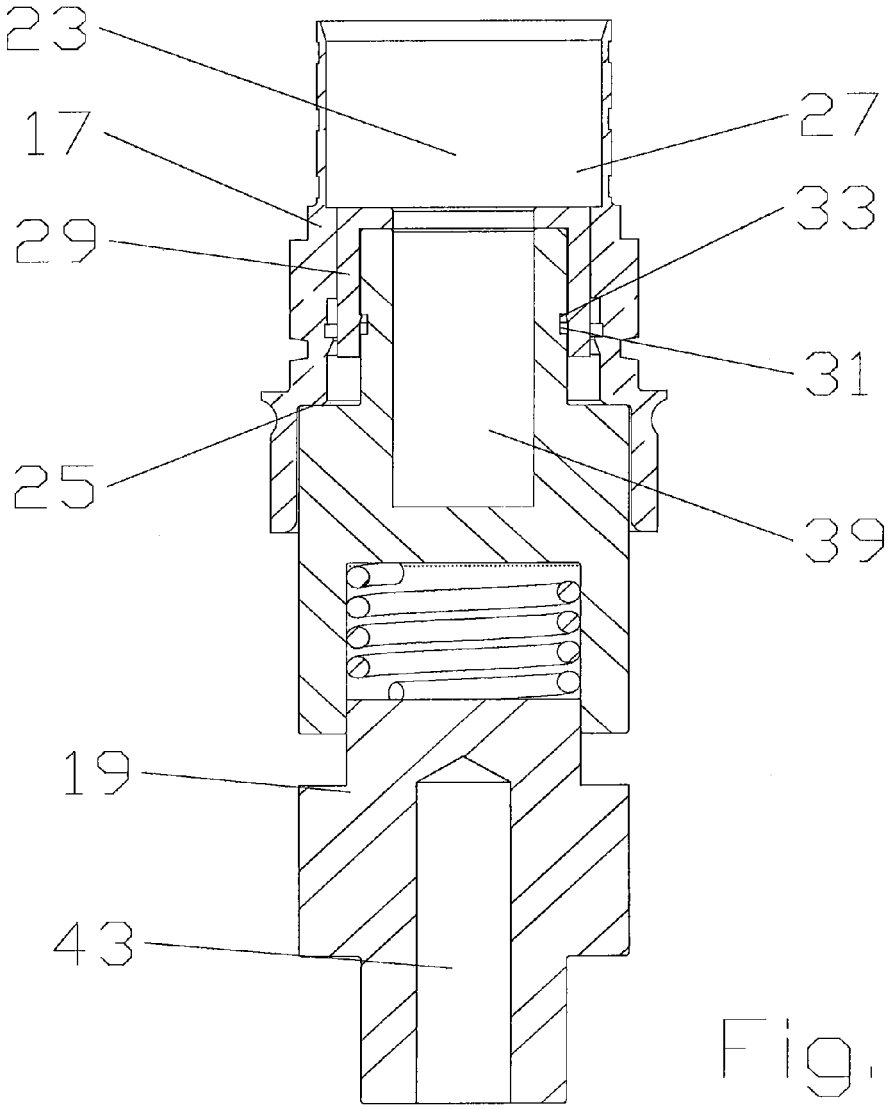
FIG. 8 shows a schematic cut-away side view of a connector body seated upon an interface pedestal with a bias element.

A connector body 17 of the connector may be seated upon the selected interface pedestal 19 of the assembly apparatus 21, the interface pedestal 19 inserted within a connector body bore 23 of the connector body 17. As best shown in FIGS. 7 and 8, the insertion pedestal 19 may be provided with a shoulder 25 dimensioned to position a solder end of the insertion pedestal 19 at a desired longitudinal position, such as flush with the edge of a solder cavity portion 27 of the connector body bore 23.

A seat 29 may be provided at the solder end of the interface pedestal 19. The seat 29 formed, for example, of a non-metallic material with insulating characteristics, such as polytetrafluoroethylene, fiberglass reinforced thermoset or polyether ether ketone or the like, provides a thermal break between the connector body 17 and the immediately adjacent portion of the insertion pedestal 19, so that heat applied to the solder cavity portion 27 is not conducted away by the insertion pedestal 19, decreasing heat application requirements and thereby the chances for thermal damage to portions of the assembly that may be damaged by excessive heating, such as the dielectric 7.

The seat 29 may also operate as a cost efficient exchangeable wear portion, protecting the interface pedestal 19. Rather than replace the entire interface pedestal 19, only the seat 29 need be exchanged when contact surfaces with of the seat 29 become worn. Thereby, the fit between the connector body 17 and the seat 29 may be cost effectively provided with a high dimensional tolerance, reducing the chance that a gap between the seat 29 and the connector body 17 large enough for significant levels of flux and/or molten solder passage may occur. The seat 29 may be removably retained upon the interface pedestal 19, for example, by a retaining element such as a gasket 31 seated in an annular groove 33 provided in the outer diameter of the interface pedestal 19.

Figure 9:
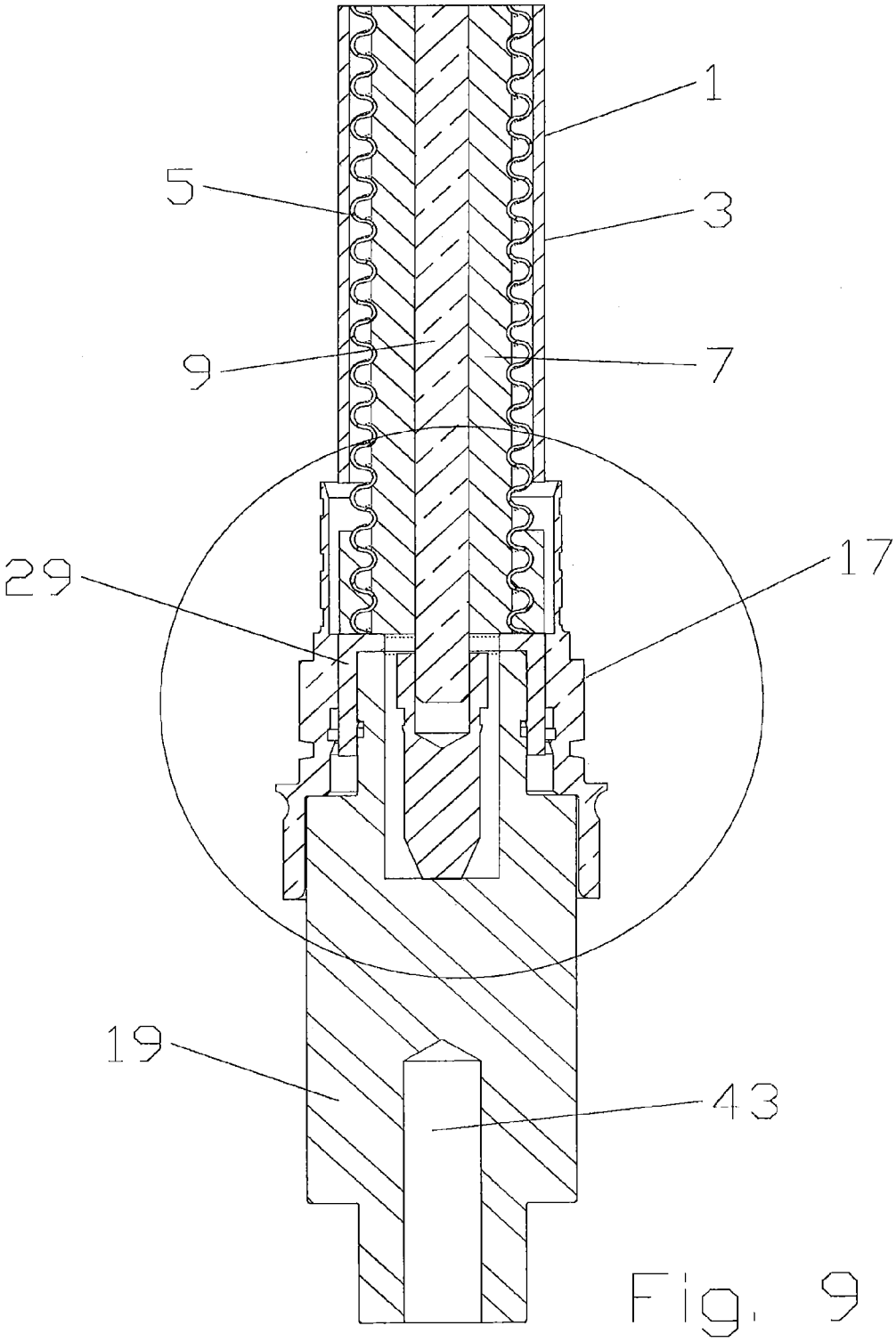
FIG. 9 shows a schematic side view of the connector body and interface pedestal of FIG. 8 with a coaxial cable inserted into the connector body bore for solder interconnection.
Figure 10:
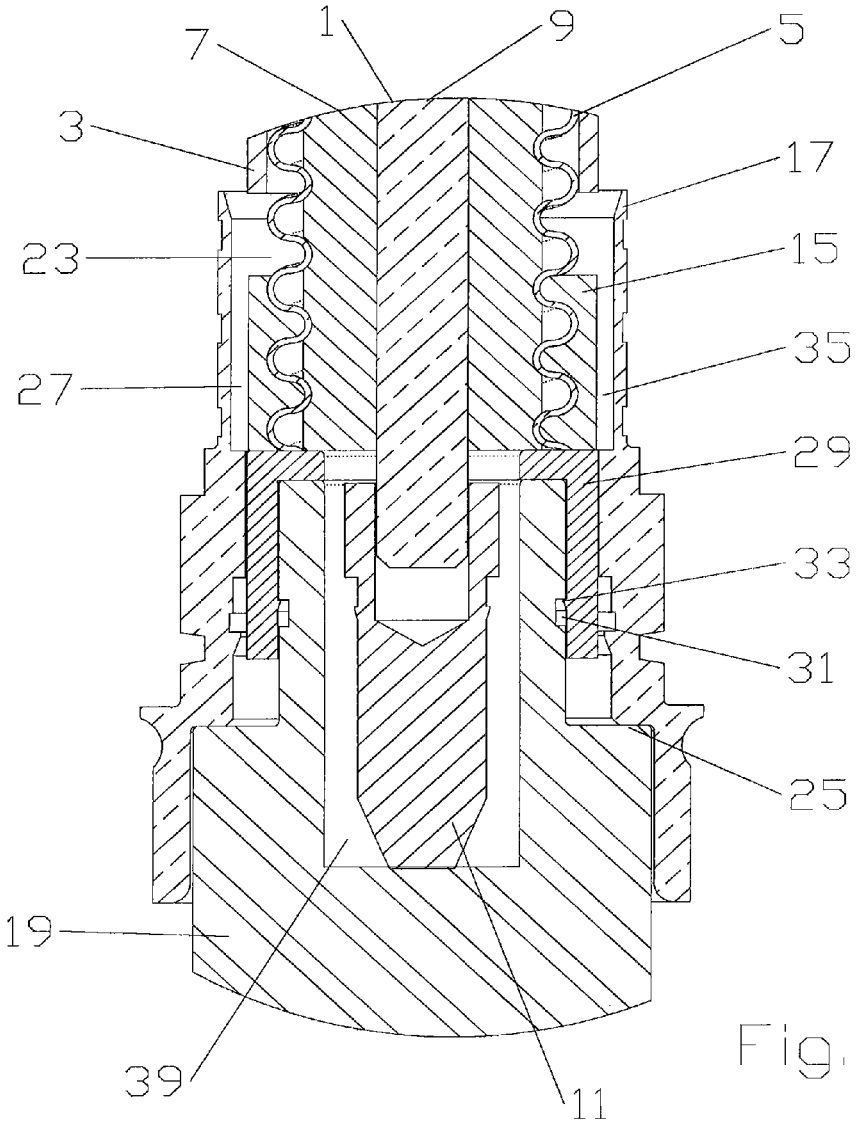
FIG. 10 shows a schematic close-up view of the structure of FIG. 9.

The prepared end of the coaxial cable 1, with the inner contact 11 and solder preform 15 attached, may be inserted into the cable end of the connector body bore 23, the connector body 17 already seated upon the interface pedestal 19, for example as shown in FIGS. 9 and 10. Upon insertion, the leading end of the outer conductor 5 seats against the seat 29, forming a solder cavity 35 between the outer conductor 5, interface pedestal (seat 29 if present) 19 and connector body 17.

Figure 1:
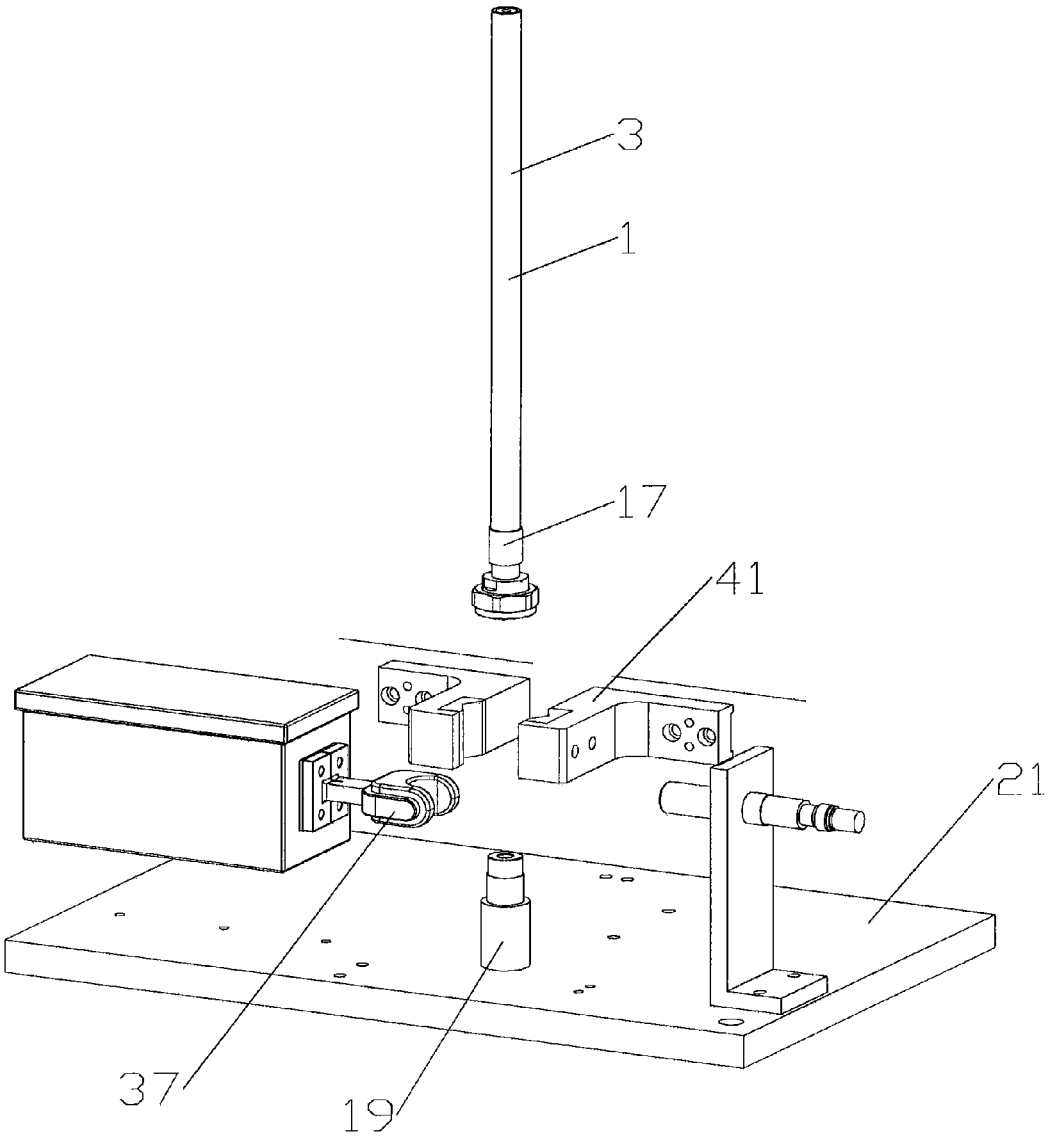
FIG. 1 shows a schematic isometric view of the primary elements of an exemplary embodiment of a cable assembly apparatus in a ready position, wherein electrical interconnections, supporting and enclosure structures are removed for clarity.
Figure 2:
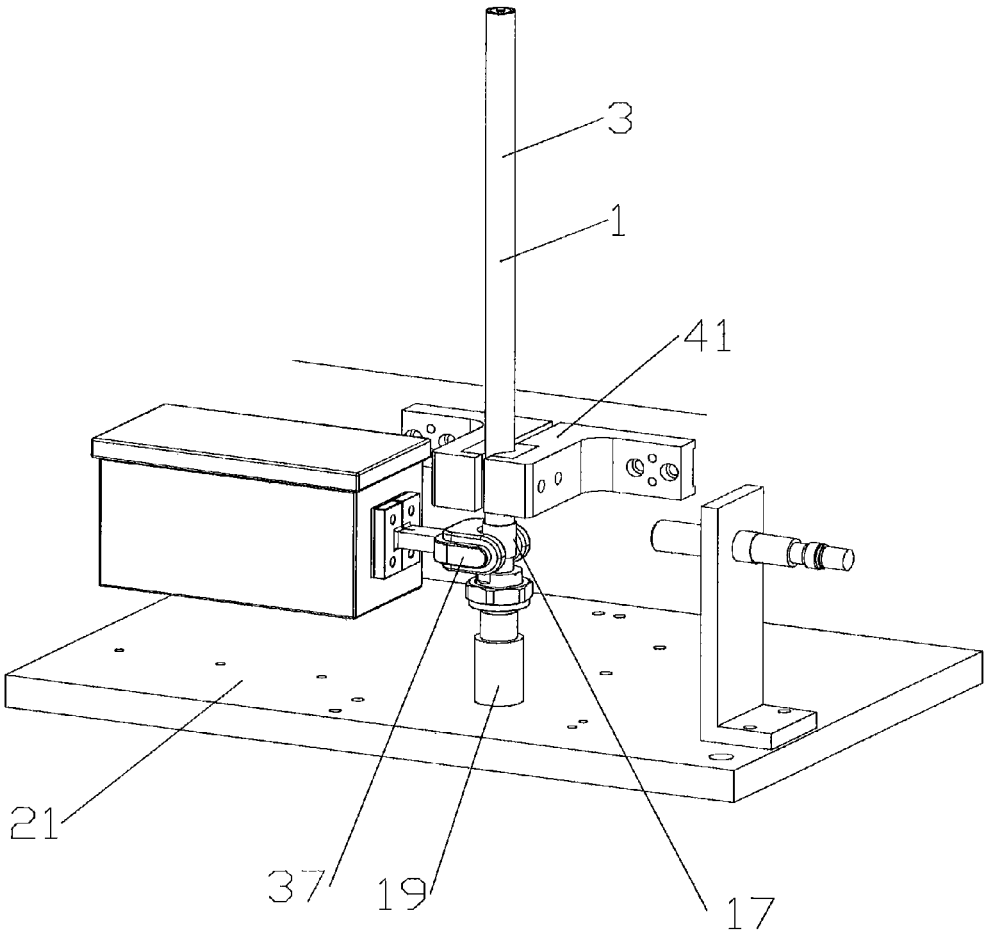
FIG. 2 shows a schematic isometric view of the primary elements of an exemplary embodiment of a cable assembly apparatus in an operation position, wherein electrical interconnections, supporting and enclosure structures are removed for clarity.

Heat, for example applied via induction heating by a U-shaped inductor 37, for example as shown in FIGS. 1 and 2, or alternatively applied directly to the exterior of the connector body 17, melts the solder preform 15, pooling solder within the solder cavity 35. Where the interface pedestal 19 is oriented with a longitudinal axis that is vertical, gravity retains the molten solder within the solder cavity 35, even though the solder cavity 35 "top" is open. An inner conductor cavity 39 open to the solder end of the interface pedestal 19 receives the inner conductor 9 with inner contact 11, if present.

Upon cooling, the solder forms an electro-mechanical joint between the outer conductor 5 and the connector body 17. One skilled in the art will appreciate that the thermal break provided by the seat 29 and/or the thermal mass of the interface pedestal 19 surrounding the inner conductor cavity 39 thermally isolates the solder interconnection between the inner conductor 9 and the inner contact 11, which may reduce a chance of overheating and/or damage to this solder connection during the outer conductor 5 to connector body 17 solder operation.

A flux and/or molten solder seal between the outer conductor 5 and the interface pedestal 19 or seat 29, if present, may be enhanced by introducing a bias therebetween, for example by providing the interface pedestal 19 or seat 29 with a range of motion along the longitudinal axis biased by a bias element, such as a spring 40, for example as shown in FIG. 8. Alternatively, a grip clamp 41, for example as shown in FIGS. 1 and 2, may be biased toward the interface pedestal 19 when the grip clamp 41 is engaged to grip the cable, thereby biasing the outer conductor 5 against the interface pedestal 19 or seat 29, if present.

For ease of use with a range of different connector interface types, the interface pedestal 19 may be configured for ease of exchange via, for example, a fastener inserted into a retention hole 43 at an assembly apparatus end of the interface pedestal 19.

One skilled in the art will appreciate that the general interconnection process does not have a specific order of operation with respect to the connector body 17 and the interface pedestal 19. For example, instead of seating the connector body 17 upon the interface pedestal 19 and then inserting the outer conductor 5 and solder preform 15 into the connector body bore 23, the outer conductor 5 and solder preform 15 may be initially inserted into the connector body bore 23 and this assembly then seated upon the interface pedestal 19.

Because the connector and cable assembly apparatus together eliminate the need for application of an additional insulating disc to each connector, the total number of connector components and the number of required assembly operations has been reduced, which may increase manufacture efficiency. Further, the elimination of the insulating disc removes an impedance discontinuity, which may improve the electrical performance of the interconnection.

The presence of the seat 29 enables tighter tolerances and may significantly extend the useful operating life of the insertion pedestal 19. Finally, the presence of the seat 29 improves thermal isolation, which may reduce the total heat and thus time required to perform the outer conductor solder operation as well as reduce the chances for thermal damage to the dielectric 7 and/or the previously applied inner conductor 9 to inner contact 11 solder connection, if present.

TABLE 1

| Table of Parts | |
|---|---|
| 1 | coaxial cable |
| 3 | jacket |
| 5 | outer conductor |
| 7 | dielectric |
| 9 | inner conductor |
| 11 | inner contact |
| 13 | solder shield |
| 15 | solder perform |
| 17 | connector body |
| 19 | interface pedestal |
| 21 | assembly apparatus |
| 23 | connector body bore |
| 25 | shoulder |
| 27 | solder cavity portion |
| 29 | seat |
| 31 | gasket |
| 33 | annular groove |
| 35 | solder cavity |
| 37 | inductor |
| 39 | inner conductor cavity |
| 40 | spring |
| 41 | grip clamp |
| 43 | retention hole |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A method for attaching a connector to a coaxial cable, comprising the steps of:

positioning a solder element between an end of an outer conductor of the coaxial cable and a connector body of the connector;

positioning the connector body on a mounting structure; and melting the solder element to form a solder joint between the outer conductor and the connector body, the solder joint including a surface formed by contact with the mounting structure;

wherein the mounting structure includes a seat that provides a surface to form the solder joint; and wherein the seat comprises a non-metallic material.

2. A method for attaching a connector to a coaxial cable, comprising the steps of: positioning a solder element between an end of an outer conductor of the coaxial cable and a connector body of the connector;

lowering the connector body onto a mounting structure; and melting the solder element to form a solder joint between the outer conductor and the connector body, the solder joint including a lower surface formed by contact with the mounting structure;

wherein the mounting structure includes a seat that provides a surface to form the solder joint; and wherein the seat comprises a non-metallic material.

3. The method defined in claim 2, wherein the solder element is a solder preform.

4. The method defined in claim 3, wherein the positioning step comprising engaging the solder perform with the end of the outer conductor prior to positioning the connector body relative to the solder preform.

5. The method defined in claim 2, wherein the mounting structure is an interface pedestal.

6. The method defined in claim 2, wherein the coaxial cable further comprises an inner conductor, and wherein an inner contact is mounted onto the inner conductor prior to the lowering step, and wherein the mounting structure includes a cavity for receiving the inner contact.

7. A method for attaching a connector to a coaxial cable, comprising the steps of:

positioning a solder element between an end of an outer conductor of the coaxial cable and a connector body of the connector;

positioning the connector body on a mounting structure; and melting the solder element to form a solder joint between the outer conductor and the connector body, the solder joint including a surface formed by contact with the mounting structure;

wherein the coaxial cable further comprises an inner conductor, and wherein an inner contact is mounted onto the inner conductor prior to the first positioning step, and wherein the mounting structure includes a cavity for receiving the inner contact.

8. The method defined in claim 7, wherein the solder element is a solder preform.

9. The method defined in claim 8, wherein the first positioning step comprising engaging the solder perform with the end of the outer conductor prior to positioning the connector body relative to the solder preform.

10. The method defined in claim 7, wherein the mounting structure includes a seat that provides a surface to form the solder joint.

11. The method defined in claim 10, wherein the seat comprises a non-metallic material.

12. The method defined in claim 7, wherein the mounting structure is an interface pedestal.

13. A method for attaching a connector to a coaxial cable, comprising the steps of:

positioning a solder element between an end of an outer conductor of the coaxial cable and a connector body of the connector, the solder element residing within a bore of the connector body;

positioning the connector body on a mounting structure, at least a portion of the mounting structure extending into the bore of the connector body; and melting the solder element to form a solder joint between the outer conductor and the connector body, the solder joint including a surface formed by contact with the mounting structure;

wherein the coaxial cable further comprises an inner conductor, and wherein an inner contact is mounted onto the inner conductor prior to the first positioning step, and wherein the mounting structure includes a cavity for receiving the inner contact.

14. The method defined in claim 13, wherein the solder element is a solder preform.

15. The method defined in claim 14, wherein the first positioning step comprising engaging the solder perform with the end of the outer conductor prior to positioning the connector body relative to the solder preform.

16. The method defined in claim 13, wherein the mounting structure includes a seat that provides a surface to form the solder joint.

17. The method defined in claim 16, wherein the seat comprises a non-metallic material.

* * * * *